US005336059A

United States Patent [19]

Rowley

[11] Patent Number: 5,336,059

[45] Date of Patent: Aug. 9, 1994

[54] ROTARY HEAT DRIVEN COMPRESSOR

[75] Inventor: C. Allen Rowley, Mesa, Ariz.

[73] Assignee: E Squared Inc., Mesa, Ariz.

[21] Appl. No.: 72,412

[22] Filed: Jun. 7, 1993

[51] Int. Cl.[5] ..... F04B 17/00; F01K 25/00

[52] U.S. Cl. ..... 417/348; 60/671

[58] Field of Search ..... 62/499, 498, 467; 417/348; 60/671

[56] References Cited

U.S. PATENT DOCUMENTS

| | | | |
|---|---|---|---|
| 2,986,898 | 6/1961 | Wood, Jr. | 62/174 |
| 2,986,907 | 6/1961 | Hoop | 62/510 |
| 2,991,632 | 7/1961 | Rogers | 62/498 |
| 3,171,268 | 3/1965 | Silver | 62/498 |
| 3,503,207 | 3/1970 | Strub | 60/671 X |
| 3,752,605 | 8/1973 | Newton | 62/498 X |
| 3,823,573 | 7/1974 | Cassady | 62/238 |
| 3,986,359 | 10/1976 | Manning et al. | 60/671 X |
| 3,988,901 | 11/1976 | Shelton et al. | 62/116 |
| 4,068,687 | 1/1978 | Long | 417/348 X |
| 4,437,308 | 3/1984 | Fischer | 60/651 X |
| 4,494,386 | 1/1985 | Edwards et al. | 62/499 X |
| 4,823,560 | 4/1989 | Rowley et al. | 62/467 |
| 4,876,856 | 10/1989 | Iishiki et al. | 62/467 X |

FOREIGN PATENT DOCUMENTS

| | | | |
|---|---|---|---|
| 19950 | 2/1980 | Japan | 60/671 |
| 2088539 | 6/1982 | United Kingdom | 60/498 |

*Primary Examiner*—Richard E. Gluck

*Attorney, Agent, or Firm*—Warren F. B. Lindsley

[57] ABSTRACT

A rotary heat driven device comprising a rotor having sections thereof mounted on a common shaft one within and off center of each of the associated axially aligned chambers. One section comprises an engine, the other a compressor and the third a liquid pump. Each section of the rotor has at least one reciprocating vane mounted to extend through and diagonally out of each of the rotor sections with vane member positioned on the ends of each vane for following along the surface of an oblong opening in each of the chambers.

6 Claims, 4 Drawing Sheets

ROTARY HEAT DRIVEN COMPRESSOR

BACKGROUND OF THE INVENTION

Dual loop heat pumps or refrigeration systems which utilize a linear motion free-piston expansion-compression device are known in the art. Such devices utilize a single working fluid in each loop of the system having a power loop which operates on a Rankine cycle and a refrigeration or heat pump loop which operates on a vapor compression cycle. One of the disadvantages of these prior art systems is that the operational efficiency thereof is poor because the linear momentum and temporary storage of kinetic energy in the free piston assembly is not utilized to compress the working fluid in the refrigeration or heat pump loop. This has resulted in such prior art systems being economically unfeasible. Further, these systems require a relatively high operating temperature and pressure for the power loop working fluid, thereby limiting the operating range.

Rotary heat driven compressors and/or engines do not use conventional pistons for compression. Instead, they work on rotary motion. When once started, the rotor turns constantly in one direction until turned off. There is no loss of efficiency due to piston action, i.e. pistons which move in one direction, stop, reverse direction, move and then stop and reverse again.

DESCRIPTION OF THE PRIOR ART

U.S. Pat. No. 4,823,560 discloses an engine or heat pump for a refrigeration system employing a first elongated expansion-compression device defining a pair of chambers, each having a linearly movable piston therein which are axially interconnected by a hollow cylinder. A second expansion-compression device is mounted within the cylinder. Conduit means are provided, one extending into each end of the first device, through the associated piston and into the cylinder. The first device forces working fluid received through the device to provide fluid under relatively high pressure to the power and work loops of a refrigeration system, while the second device actuated by the first device draws relatively low pressure fluid from the system and returns it under pressure to a source.

U.S. Pat. No. 2,986,907 discloses a refrigeration system designed to operate from a low energy source such as hot water or a small capacity electrical heating unit. A pair of pistons are connected together in a housing with each piston designed to compress a low flash point refrigerant. The pistons are powered by measured charges of the refrigerant which are passed through a flash chamber and there substantially and instantaneously converted from a liquid to a gas with the resulting expansion in volume used to drive the pistons against the gaseous refrigerant on the other side of the pistons for compressing it.

U.S. Pat. No. 3,823,573 discloses an automotive air conditioning apparatus wherein gas from an evaporator is introduced to a double acting piston and cylinder arrangement exhausting by a check valved conduit which then delivers the refrigerant gas at an elevated pressure to a water jacket heat exchanger.

U.S. Pat. No. 2,991,632 discloses a refrigeration system of the compressor-condenser-expansion type, wherein the compressor is driven by the refrigerant gas itself. This is accomplished by utilizing a compressor which is driven or powered by a gas or vapor under pressure, extracting a portion of the refrigerant from any suitable portion of the compressor-condenser-expander circuit, thereby increasing the pressure of the extracted refrigerant by means of a pump and increasing the volume thereof by the application of heat thereto.

U.S. Pat. No. 3,988,901 discloses a dual loop heat pump system including an expansion-compression device with a linearly movable free piston assembly. A Rankine cycle power loop with a working fluid is operatively connected to the expansion-compression device to drive same. A vapor compression heat pump loop with a working fluid is operatively connected to the expansion-compression device to be driven thereby.

U.S. Pat. No. 2,986,898 discloses a refrigeration system with refrigerant operated pump which is energized by the refrigerant for returning low pressure refrigerant to the high pressure side of the system.

SUMMARY OF THE INVENTION

In accordance with the invention claimed, a rotary heat driven engine is disclosed which can do many types of work such as pumping liquids and/or turning a generator or alternator all requiring rotary motion. The disclosed engine is ideally suited for a refrigeration cycle. In the engine disclosed, pressure comes from the expansion of a gas and as the gas is cooled it returns to a liquid. In the work chamber, the action is reversed when drawn into and compressed to a liquid by a cooling condenser. The liquid pump returns the liquid refrigerant back to the high pressure side of the cycle.

This rotary engine does not require valves and the proper placement of the intake and exhaust ports provides the timing necessary for the intake and exhaust cycles. These ports are so positioned that the vanes of the engine will feel the effects of the incoming gas before the gas being exhausted is completely dissipated. This action will prevent the occurrence of a "dead" spot when the engine is turned off. When gas under pressure enters the cylinders, it always applies pressure to the vanes, turning them in the proper direction.

Present day piston compressors are run by electrical motors. The disclosed and claimed rotary engine is run on a small heat differential, as small as fifty degrees. The rotary engine can be run by any heat source, including waste heat. When a temperature difference exists between the condenser and evaporator, a pressure difference also exists. This temperature difference between the condenser and evaporator causes liquid refrigerant to expand in the evaporator. Since the evaporator output is connected to engine input, the expanding refrigerant drives the engine.

This engine could be driven by waste heat from another refrigeration cycle, either directly coupled to the existing compressor, or independent thereof thereby reducing energy costs.

It is, therefore, an object of the present invention to provide a new and improved rotary actuator, engine or heat actuated pump for, inter alia, a refrigeration system.

Another object of this invention is to provide a heat pump that is powered exclusively by heat energy drawn directly from the surrounding environment.

A further object of this invention is to provide a new and improved rotary engine embodying a liquid refrigerant pump within its geometrical configuration.

A still further object of this invention is to provide a rotary heat pump in a simplified form, utilizing a reduced number of elements as compared with prior art heat actuated pumps.

A still further object of this invention is to provide a heat actuated heat pump that may use only a single refrigerant in both the power and work loops.

Further objects and advantages of the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
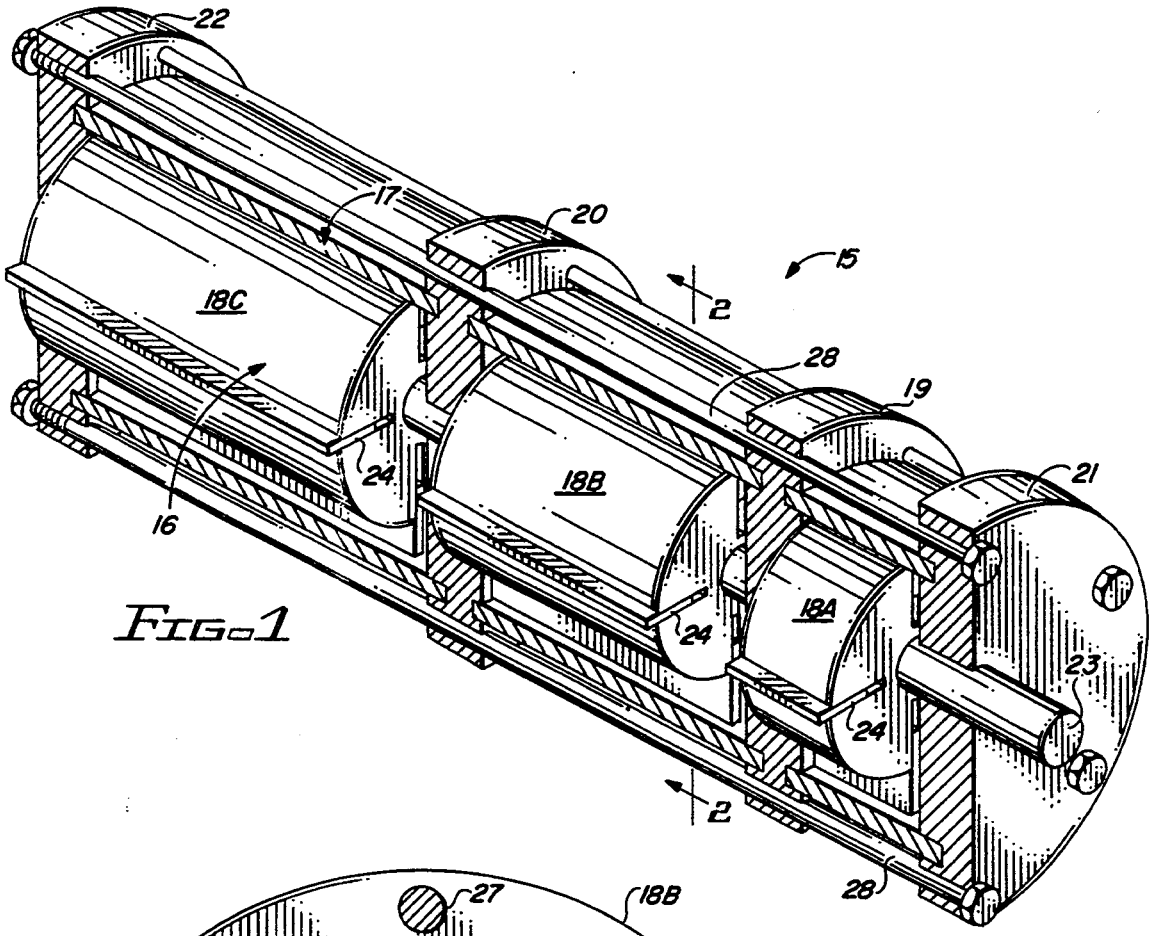
FIG. 1 is a perspective view of a rotary heat driven compressor and embodying the invention.
Figure 2:
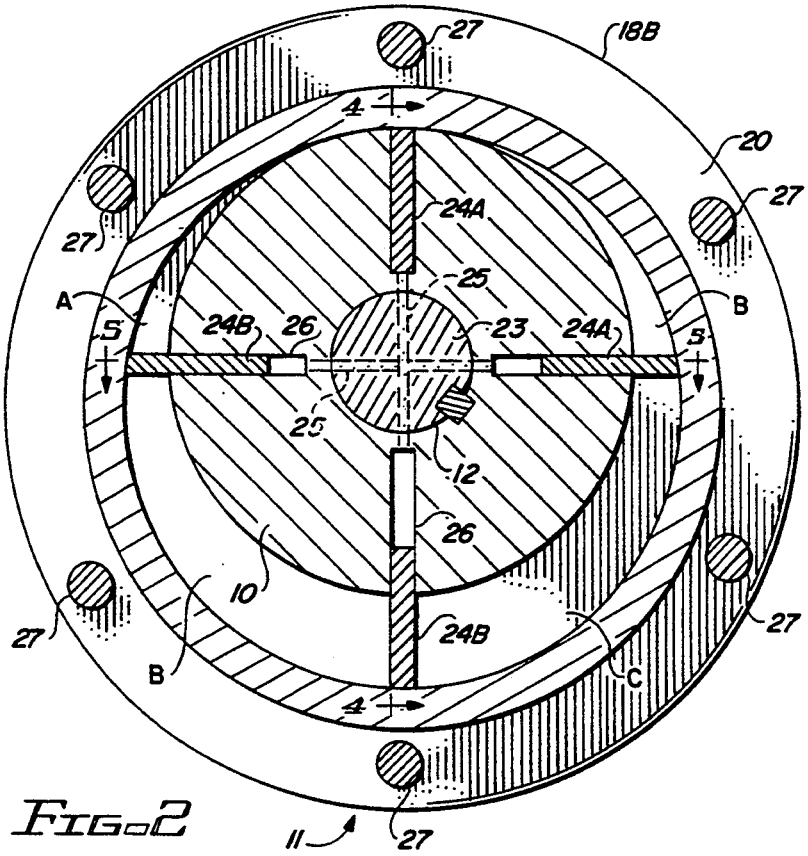
FIG. 2 is a cross sectional view of FIG. 1 taken along the line 2—2.
Figure 3:
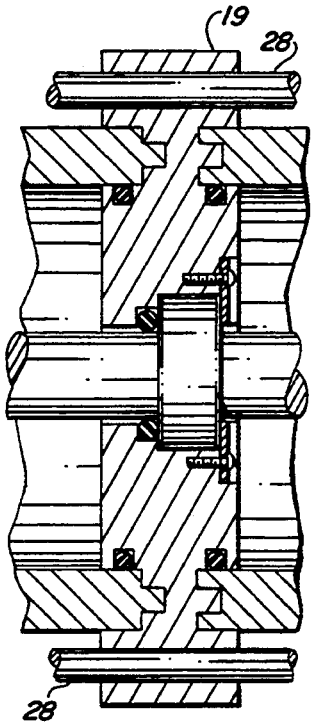
FIG. 3 is a cross sectional view of one of the center plates shown in FIG. 1.
Figure 8:
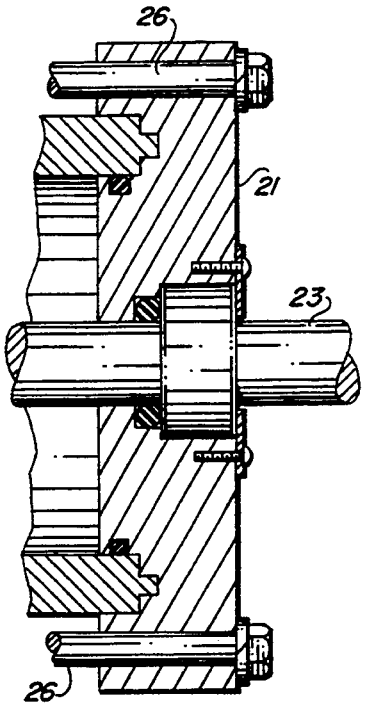
FIG. 8 is a cross sectional view of the right end of FIG. 1 with the other end being a mirror image thereof.

Referring more particularly to the drawings by characters of reference, FIGS. 1 and 2 disclose a rotary type heat driven apparatus 15 comprising a rotor 16 having sections thereof mounted within and off center of a cylinder 17. Rotor 16 comprises three sections 18A, 18B and 18C formed by center plates 19 and 20 and end plates 21 and 22 and having a common shaft 23 extending axially therethrough and journalled in the center and end plates as shown in FIGS. 3 and 8. Section 18A of rotor 16 forms a liquid pump for apparatus 15 with sections 18B and 18C thereof forming the compressor and engine components, respectively, of the apparatus.

Figure 4:
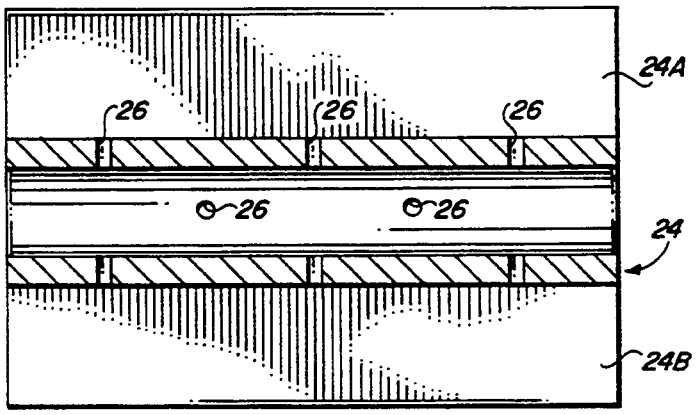
FIG. 4 is a cross sectional view of FIG. 2 taken along the line 4—4.
Figure 5:
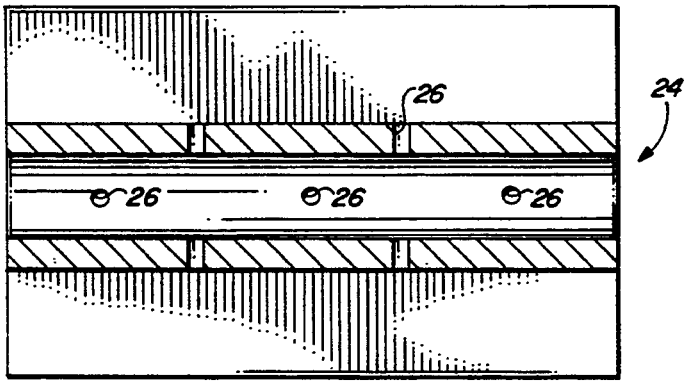
FIG. 5 is a cross sectional view of FIG. 2 taken along the line 5—5.
Figure 6:
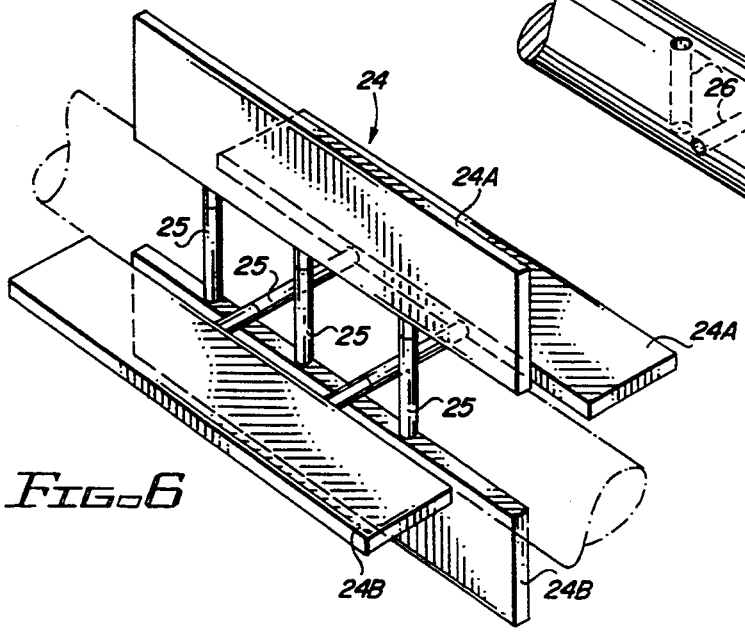
FIG. 6 is a diagrammatic perspective view of the vanes shown in FIGS. 1 and 4 and their rods to show their relationship to each other with its associated shaft shown in dash lines.
Figure 7:
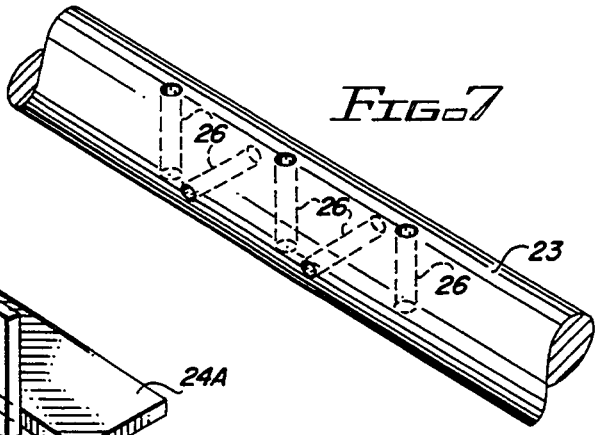
FIG. 7 illustrates the shaft shown in FIG. 6 with the holes for the vane rods.

Each section of rotor 16 has movably mounted thereon one or more fins or vanes 24 with each vane comprising vane members 24A and 24B, as shown in FIGS. 4–6 extending diagonally of rotor 16 in openings 26 and interconnected by a rod 25 which extends through an opening 26 in rotor 16 and shaft 23 and is fixedly attached at its ends to the associated vane members 24A and 24B.

As vane members 24A and 24B are acted upon by fluid under pressure, this action causes shaft 23 and the associated rotor sections 18A, 18B and 18C to rotate with vane members 24A and 24B reciprocating in their respective opening 26 as the vane members follow the oblong inside periphery of cylinder 17.

Rotor 16 and each of its sections is mounted within hollow cylinder 17 in an off center manner thereby creating gas expansion sections A and B in each section of the cylinder between the associated rotor section and the inside surface of the cylinder which vary in volume as rotor 16 revolves in cylinder 17.

Plates 19–22 are shown as being provided with bolt holes 27 for clamping the parts or sections of engine 15 in a cylindrical configuration by rods or bolts 28 extending therethrough but may be constructed in any suitable manner.

Apparatus 15 does not require any valves in its component parts, namely sections 18A, 18B and 18C since the placement of the intake and exhaust ports in cylinder 17 takes care of the timing to provide a proper intake and exhaust cycle. Seals may not be required in any of the chambers A and B of sections 18A, 18B and 18C as the cylinder and associated rotors of the engine, compressor and pump are manufactured to close tolerances. The plates 19–22 form end caps for each section of the assembly.

Figure 9:
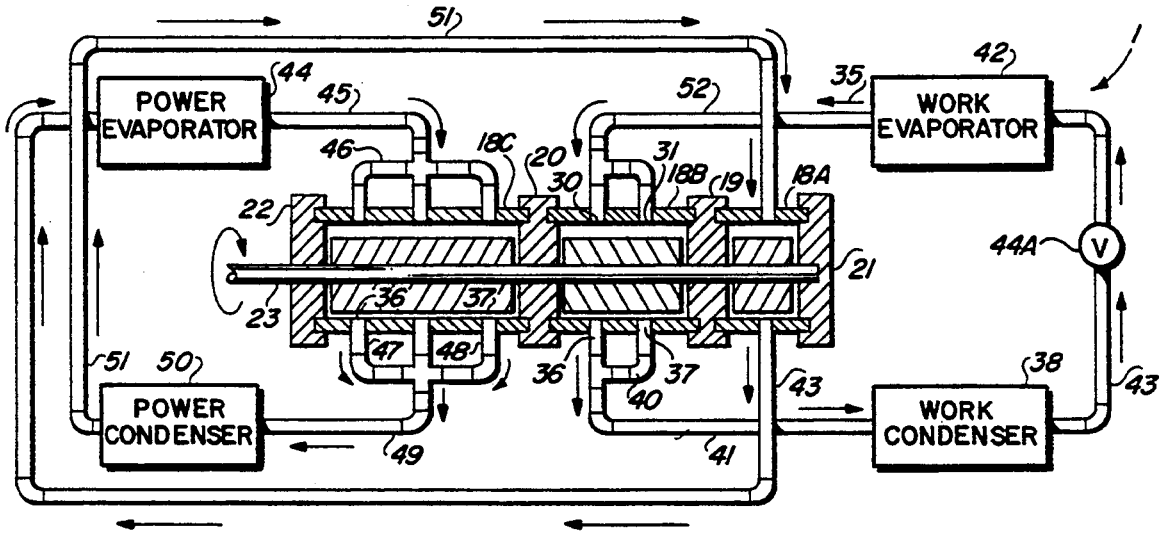
FIG. 9 is a functional block diagram of a refrigeration system embodying the rotary heat driven compressor shown in FIG. 1.
Figure 10:
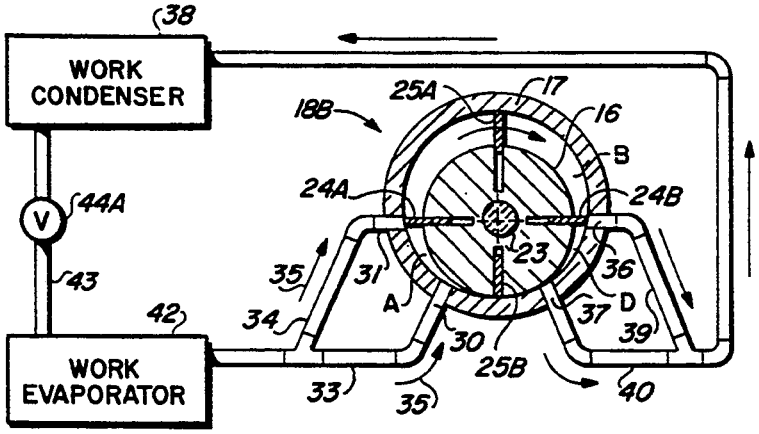
FIG. 10 is a functional block diagram of the compressor section of FIG. 1.
Figure 11:
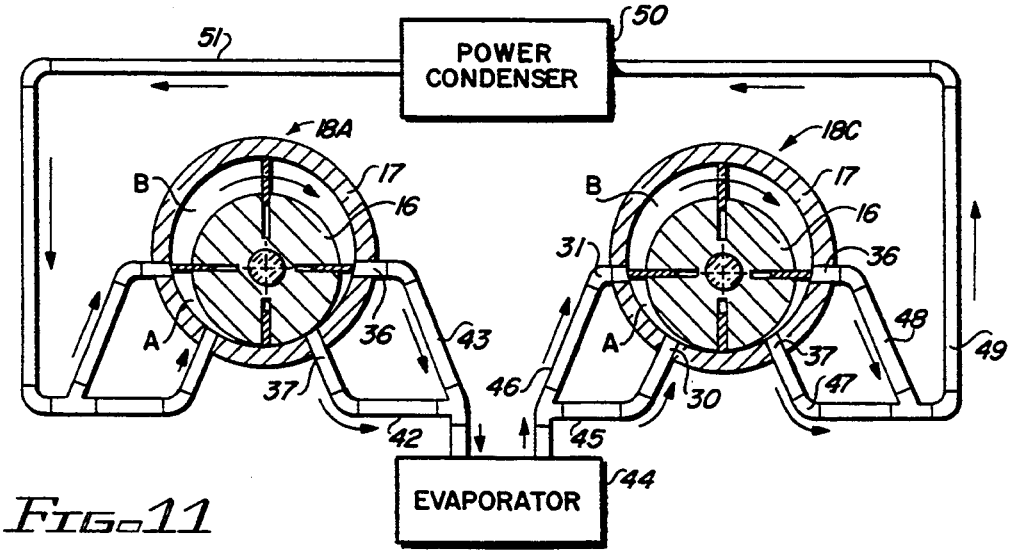
FIG. 11 is a functional block diagram of the liquid pump and engine driven section of FIG. 1.

FIG. 9 is a cross sectional view of heat driven apparatus 15 with FIGS. 10 and 11 disclosing in more detail the compressor in FIG. 10 and the engine and work pump in FIG. 11.

With reference to the compressor shown in FIG. 10, expanding gases will enter through intake ports 30 and 31 and exert pressure on vane member 24A. Vane member 24A and its associated vane member 24B are held in place by each section of rotor 16 causing both rotor and vane members 24A and 24B to rotate on and with shaft 23. The pressure is continuous on the vane member 24A in section A of the compressor portion of the engine as shown in FIG. 10.

The inner wall of cylinder 17 may be round, or slightly oval as shown. If it is slightly oval, this occurs because shaft 23 through the center of rotor 16 is not mounted in the center of cylinder 17 but is offset therefrom.

The section of rotor 16 in the compressor portion of the engine, as shown in FIG. 10, is very close to the inner wall of cylinder 17, approximately 0.001 inches at the closest point, but not touching. Since the rotor is smaller in diameter than cylinder 17 there is an area between the rotor and the inner cylinder wall which gets progressively larger then smaller upon rotation of the rotor with the maximum space between the rotor's outside periphery and the inside periphery of the cylinder being diametrically opposite the closest point. This space A as shown in FIG. 10 is filled with gas under pressure as it enters from intake ports 30 and 31 and exerts pressure on vane member 24A causing rotor 16 to turn. This area or space A is the expansion chamber of the engine.

The oval space inside cylinder 17 is vital to this design since it allows rotor 16 with its vanes 24 to sit approximately 0.001 of an inch away from the inner cylinder wall at all times. This 0.001 of an inch distance is merely used as an example of a given close tolerance and could be varied and still fall within the scope of this invention. This distance, however, provides a seal for the expanding vapor introduced therein. This seal is also necessary for the engine component of this apparatus to start rotation or to run at low speeds.

Any or all rotor sections of the apparatus may employ single or multiple vanes depending on the results desired.

Although rotor 16 does not touch the inside walls of the sections of cylinder 17 through which it traverses, the vanes are constantly moving in and laterally of the rotor as it turns. When one end of vane 24 is at the point where rotor and cylinder walls are the closest, the opposite end of the vane has maximum protrusion from the rotor. From this point, as rotation continues, the cylinder wall will exert pressure on the edge of the vane members, causing them to start to protrude from the rotor on the opposite side. Refrigerant vapor containing wet droplets or liquid refrigerant is always present and will act as a lubricant. These vanes are not spring loaded thereby avoiding the undesirable features of springs and their limitations.

Referring again to FIG. 10, as vapor under pressure from work evaporator 42 is transmitted through pipelines 33 and 34 and through inlet ports 30 and 31, respectively, and into cylinder 17 vapor as shown by arrows 35 fills space A in the section of cylinder 17 associated with the compressor portion of the engine and impinges on vane member 24A causing rotor 16 and shaft 23 to be rotated clockwise in cylinder 17. As vane member 24A is rotated, the remaining refrigerant from a previous cycle in this section of the cylinder moves out of chamber B through outlet ports 36 and 37. The expanded evaporative gas such as a liquid refrigerant is sequentially exhausted to the low pressure side of work condenser 38 by pipelines 39, 40 and 41. Work condenser 38 is connected to a work evaporator 42 by a pipeline 43 through an expansion valve 44A.

FIG. 11 illustrates the liquid pump of section 18A, shown in FIG. 9, connected to the engine section 18C.

It should be noted that the three sections 18A, 18B and 18C all contain the same rotor, vane and cylinder configuration wherein like parts are given the same reference characters. Section 18A is the liquid pump section while section 18B is the compressor and section 18C is the engine section of the apparatus.

As noted from FIG. 9, power section 18C is the largest section of the apparatus with section 18B being the driven section, i.e. the compressor, and section 18C being the smallest section, i.e. the liquid return pump. Section 18C returns liquid refrigerant to the high pressure side of the engine where it will be reheated to a gas.

The ratio between the power and work cycles may be obtained by defining the length of the chambers i.e. the length of the rotor and cylinder of a given section of the engine. The power chamber is the longest as shown in FIGS. 1 and 9 with the work chamber or compressor being shorter and with the liquid return pump section being the shortest of the three sections. The three cylinder sections or chambers making up the engine may be in any order and the ratios can be changed either by lengthening the chambers or enlarging the diameter of the cylinders.

FIG. 11 illustrates the liquid pump of section 18A of apparatus 15 connected to the engine section 18C of the apparatus. As shown, the output of the liquid pump is transmitted through pipelines 42 and 43 to evaporator 44 wherein the liquid refrigerant is vaporized and transmitted via pipelines 45 and 46 to inlet ports 30 and 31 of the engine section 18C of the apparatus. The discharge of the engine section 18C is transmitted through outlet ports 36 and 37 through pipelines 47, 48 and 49 to a boiler or power condenser 50 from which it is transmitted through pipeline 51 to the inlet ports 30, 31 of the liquid pump of sections 18A.

With reference to FIG. 9, it should be noted that a single structure is provided for a rotary apparatus that uses a common shaft 23 for supporting a similar vane structure in each of three different sections of the apparatus with each section performing a different function.

FIG. 9 is a simplified drawing of the engine sections 18A, 18B and 18C of the apparatus in a unitary configuration. In FIG. 9 liquid refrigerant in the boiler or evaporator 44 is heated to a vapor creating pressure. The vapor flows from evaporator 44 through pipelines 45 into the power chamber of section 18C of the engine where it exerts pressure on vanes 24 causing the shaft to rotate. When the gas reaches the discharge or outlet ports 36 and 37, it flows through pipelines 47, 48 and 49 to the power condenser 50 where it becomes a liquid. It then flows in liquid form through pipelines 51 to the liquid pump forming section 18A of apparatus 15 where the ratio between the power cylinder of section 18C and the pump is great enough to pump the liquid refrigerant under pressure back into the boiler or power evaporator 44.

In the work cylinder or compressor of section 18B, refrigerant on the suction side thereof flows from evaporator 42 through pipe lines 52 into the work cylinder of section 18B. On reaching the discharge vents of section 18B, the refrigerant, now on the high side of the evaporator flows through lines 40 and 41 to the work condenser 38 where heat is removed in the known manner. The liquid refrigerant then flows through pipeline 43 through an expansion valve 44 where it is converted into a vapor to the work evaporator 42.

In FIG. 9, liquid refrigerant in the boiler or power evaporator 44 is heated to a vapor creating pressure. The vapor flows through pipelines 45 into the power chamber of section 18C of the engine where it exerts pressure on vanes 24 of the engine causing shaft 23 to rotate. When the gas reaches the discharge ports 36, 37 of section 18C, it flows through pipelines 49 to the power condenser 50 where it becomes a liquid. The liquid then flows through pipelines 51 to the liquid pump of section 18A of the engine where the ratio between the power cylinder and the pump is great enough to pump the liquid refrigerant under pressure back through pipeline 42 into boiler or power evaporator 44.

In the work cylinder 18B of apparatus 15, refrigerant on the suction side flows from the work evaporator 42 through pipelines 52 into the work cylinder or compressor of section 18B. On reaching the discharge vents 36, 37 of section 18B of the apparatus, the refrigerant now on the high side of condenser 38 flows through pipeline 43 as a liquid through the expansion valve 44A where it becomes a vapor and on into the work evaporator 42.

Figure 13:
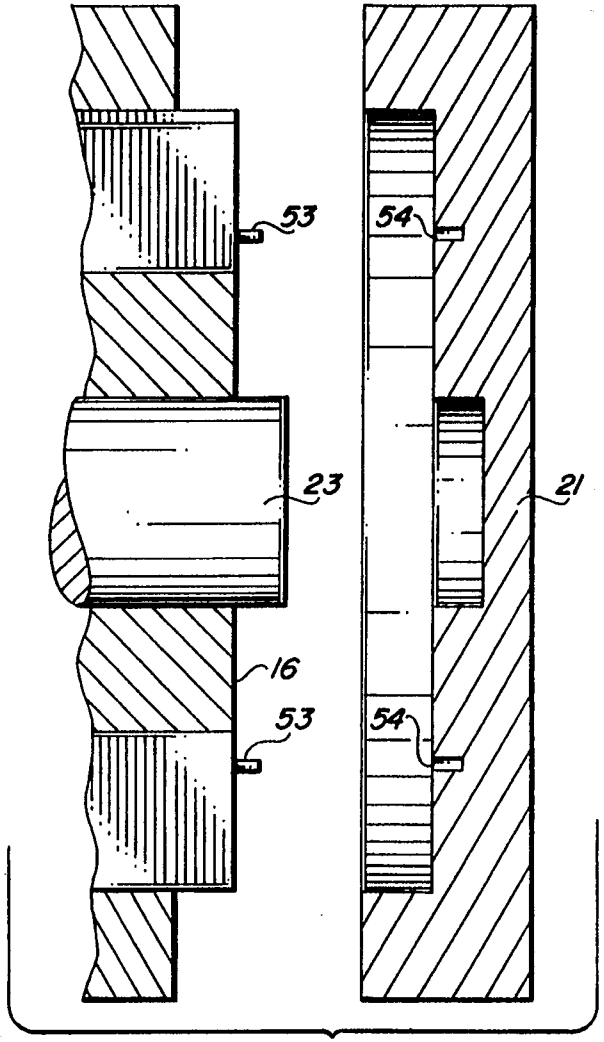
FIG. 13 is a cross sectional view of FIG. 12.
Figure 12:
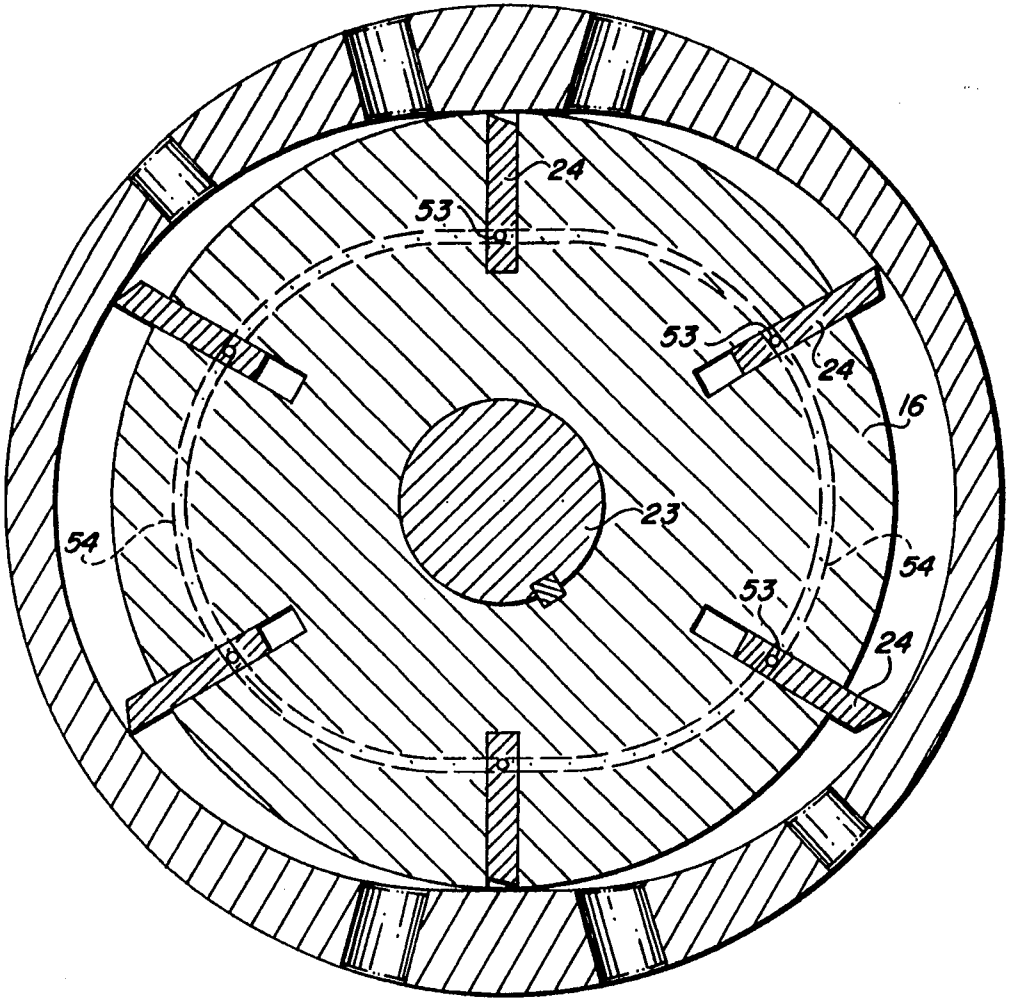
FIG. 12 is a modification of the heat driven rotary engine shown in FIG. 9 embodying a cam driven function for vane operation.

FIGS. 12 and 13 disclose a further embodiment of the invention wherein vanes 24' of the rotor are cam operated. As shown, vanes 24' are each provided with a pin 53 extending laterally therefrom the free ends of which protrude into a slot 54 in the end plate 21 of the engine. As shaft 23 and the associated rotor 16 rotates the movement of vanes are controlled by pins 53 moving over and in the cam surface formed by slot 54.

Although but a few embodiments of the invention have been illustrated and described, it will be apparent to those skilled in the art that various changes and modifications may be made therein without departing from the spirit of the invention or from the scope of the appended claims.

What is claimed is:

1. A rotary heat driven compressor comprising:

a fluid conducting work loop comprising a condenser means connected with an evaporator means, a rotary engine means comprising a hollow cylinder the periphery of the hollow interior defining an oblong cross sectional configuration, and a rotor mounted within said cylinder offset from the center line of said cylinder with the periphery of said rotor in one area being juxtapositioned to in a vapor tight arrangement with the inside periphery of said cylinder, reciprocating vane means diagonally mounted on said rotor to extend outwardly thereof for following the inside periphery of said cylinder upon rotation of said rotor, said reciprocating vane means comprising a pair of vane members interconnected by a rod which rod extends through an opening diagonally positioned in said rotor, one of said vane members being movable into said opening when said rotor is in said one area while the other of said vane members at that time extending laterally outwardly of said rotor, said reciprocating vane means comprising a second pair of vane members with each pair being mounted on said rotor ninety degrees from the other, inlet port means formed to extend into the hollow interior of said cylinder on one side of said vane means, outlet port means mounted to extend through said cylinder on the other side of said vane means, and conduit means for connecting said inlet port means to the output end of said evaporator means and said outlet port means to the input end of said condenser means for fluid transmission.

2. An engine comprising:

an elongated hollow cylindrical device having a pair of end plates and two section plates defining within said device first, second and third axially aligned chambers of different lengths separated by said section plates, the hollow interior of each of said chambers defining an oblong cross sectional configuration, a shaft extending axially through each chamber of said device, rotor means mounted on said shaft for rotation therewith with a portion thereof being mounted on said shaft in each of said chambers, inlet and outlet ports extending through the walls of each of said chambers, the portion of said rotor means in each chamber being mounted on said shaft offset from the center line of said chamber with the periphery of said portion in one area of each chamber being juxtapositioned to and in a vapor tight arrangement with the inside periphery of the associated chamber, reciprocating vane means diagonally mounted on said rotor means in each chamber to extend outwardly thereof for following the inside periphery of the associated chamber upon rotation of said shaft, a fluid conducting power loop comprising a first evaporator means interconnected with a first condenser means, a fluid conducting work loop comprising a second evaporator means interconnected with a second condenser means, said power loop and said work loop functioning with a common working fluid, a first pipe means for connecting said inlet port of one of said chambers to the output end of said first evaporator means and said outlet port of said one of said chambers to the input end of said first condenser means, whereby fluid under pressure injected into said one of said chambers rotates the shaft in each of said chambers, and a second pipe means for connecting said inlet port of another one of said chambers to the output end of said second evaporator means and said outlet port of said another of said chambers to the inlet end of said second condenser means, and a third pipe means for connecting said outlet port of said third chamber with the inlet port of said first evaporator means and said inlet port of said third chamber with said outlet port of first condenser means for forming a fluid pump for circulating under pressure fluid through said power loop.

3. The engine set forth in claim 2 wherein:

said first, second and third chambers are each progressively shorter in length.

4. The engine set forth in claim 2 wherein:

the periphery of said rotor in said one area is approximately 0.001 of an inch from the inside wall of the associated chamber.

5. The engine set forth in claim 2 wherein:

said working fluid comprises a refrigerant.

6. An engine comprising:

an elongated hollow cylindrical device having a pair of end plates and a section plate defining within said device first and second axially aligned chambers of different lengths separated by said section plate, the hollow interior of each of said chambers defining an oblong cross sectional configuration, a shaft extending axially through each chamber of said device, rotor means mounted on said shaft for rotation therewith a portion thereof being mounted on said shaft in each of said chambers, inlet and outlet ports extending through the walls of each of said chambers, the portion of said rotor means in each chamber being mounted on said shaft offset from the center line of said chamber with the periphery of said portion in one area of each chamber being juxtapositioned to and in a vapor tight arrangement with the inside periphery of the associated chamber, reciprocating vane means diagonally mounted on said rotor means in each chamber to extend outwardly thereof for following the inside periphery of the associated chamber upon rotation of said shaft, a fluid conducting power loop comprising an evaporator means and a condenser means, a first pipe means for connecting said inlet port of one of said chambers to the output end of said evaporator means and said outlet port of said one of said chambers to the input end of said condenser means, and a second pipe means for connecting said inlet port of another one of said chambers to the output end of said condenser means and said outlet port of said another of said chamber to the inlet end of said evaporator means.

* * * * *